US007797853B2

(12) United States Patent
Compton

(10) Patent No.: US 7,797,853 B2
(45) Date of Patent: Sep. 21, 2010

(54) PICTURE HANGER PLACEMENT DEVICE

(76) Inventor: Clark M. Compton, 5412 Mountain Gate Cir., Lakeside, AZ (US) 85929

( * ) Notice: Subject to any disclaimer, the term of this patent is extended or adjusted under 35 U.S.C. 154(b) by 133 days.

(21) Appl. No.: 12/309,184

(22) PCT Filed: Jun. 25, 2007

(86) PCT No.: PCT/US2007/014660

§ 371 (c)(1),
(2), (4) Date: Jan. 9, 2009

(87) PCT Pub. No.: WO2008/020916

PCT Pub. Date: Feb. 21, 2008

(65) Prior Publication Data

US 2009/0313843 A1 Dec. 24, 2009

(51) Int. Cl.
*G01B 5/25* (2006.01)

(52) U.S. Cl. ..... 33/613; 33/666; 248/489

(58) Field of Classification Search ..... 33/613, 33/645, 666; 248/489
See application file for complete search history.

(56) References Cited

U.S. PATENT DOCUMENTS

| | | | | |
|---|---|---|---|---|
| 4,220,309 | A | 9/1980 | Eisen et al. | |
| 4,517,860 | A | 5/1985 | Dameron, Jr. | |
| D282,054 | S | 1/1986 | Hoffman | |
| 4,893,776 | A | 1/1990 | Floyd | |
| D317,575 | S | 6/1991 | Ramsey | |
| 5,180,135 | A | 1/1993 | Hindall | |
| 5,471,760 | A | 12/1995 | Farris | |
| 6,032,378 | A * | 3/2000 | Null | 33/613 |
| 6,049,991 | A | 4/2000 | Gruenberg et al. | |
| 6,185,831 | B1 | 2/2001 | Pluciennik | |
| 6,739,065 | B2 | 5/2004 | Hofmeister et al. | |
| 6,957,797 | B1 | 10/2005 | Strobel | |
| 6,971,184 | B2 | 12/2005 | Prevost | |
| D513,575 | S | 1/2006 | Carson et al. | |
| 7,155,840 | B1 * | 1/2007 | Carbonaro | 33/613 |
| 2002/0078582 | A1 | 6/2002 | Krake et al. | |
| 2003/0051363 | A1 * | 3/2003 | Hofmeister et al. | 33/613 |
| 2004/0177527 | A1 | 9/2004 | Prevost | |
| 2008/0196262 | A1 * | 8/2008 | Bommarito | 33/613 |

* cited by examiner

*Primary Examiner*—G. Bradley Bennett
(74) *Attorney, Agent, or Firm*—Richard C. Litman

(57) ABSTRACT

The picture hanger placement device (10) compensates for the span between a picture hanger fastener and the lowermost portion of a picture hanger hook, (the bight) (B). The device includes a plate (12) that has a handle (54) at the top and a hook-type picture hanger (30) at the bottom. An adjustable slide moves within an elongate slot (26) between the top and the bottom of the plate. A picture hanger position marker is attached to the back of the slide. The slide is adjusted according to the dimensions of a picture hanger bracket (H) so that the picture hanger position marker marks the spot on a vertical wall where a picture hanger fastener (such as a nail) should be placed so that a picture hanger bracket (H) retains the picture in the desired position.

15 Claims, 3 Drawing Sheets

PICTURE HANGER PLACEMENT DEVICE

TECHNICAL FIELD

The present invention relates generally to alignment, marking, and positioning gauges and the like. More specifically, the present invention is a device for precisely locating the position of a fastener in a wall or similar surface for a picture hanger or the like, allowing for any difference between the vertical position of the hanger fastener and the lowermost point of the hook of the hanger.

BACKGROUND ART

A chronic problem in the placement of pictures and decorations on a wall surface is the precise location of the fastener hole in the wall in order to precisely position the hanger and the picture or decoration on the wall. While this is not especially critical when only a single hanger is used to hang a single picture or decoration upon a wall or similar surface, or when multiple decorations are widely spaced, it can become critical when multiple hangers are used for a single larger picture or decoration, or when two or more pictures or decorations of identical size are placed adjacent to one another. Even a fraction of an inch of vertical misalignment between the two (or more) hangers results in an annoying and unsightly perception of disorganization.

Accordingly, most persons engaged in the hanging of such pictures or decorations make very meticulous measurements in order to position the hangers precisely on the wall or other surface. When one is dealing with vertical differences of small fractions of an inch between two horizontally widely spaced locations, it is quite difficult to assure the precision needed to avoid any perception of misalignment between the two objects. However, even when those measurements are precise, variations in the dimensions of the hangers themselves can throw off the final outcome.

Thus, a picture hanger placement device solving the aforementioned problems is desired.

DISCLOSURE OF INVENTION

The disclosure is directed to a picture hanger placement device. The picture hanger placement device comprises a thin, flat, elongate plate with an elongate slot extending completely through the plate, and a recessed slide track defined in the rear surface of the plate and surrounding the slot. A picture hanger placement device hook is immovably affixed to and extends from the front surface of the plate adjacent to the lower end thereof. The hook has an apex that is adapted to support a wire or other hardware associated with hanging a picture or display. The picture hanger placement device also includes a flat infinitesimally adjustable slide disposed within the slide track on the rear surface of the plate. A picture hanger position marker is immovably affixed to and extends from the slide in a position opposite the slot. A position locking fastener is disposed on the front surface of the plate. The position locking fastener has a connecting portion that extends through the slot and engages the slide. In operation, the slide is adjusted so that the picture hanger position marker marks a position on a corresponding support surface that enables a user to precisely position a picture or display on the support surface.

The disclosure is also directed to a picture hanger placement device that includes linear measurement scales and other features. The picture hanger placement device comprises a thin, flat, elongate plate with an elongate slot extending completely through the plate, and a recessed slide track defined in the rear surface of the plate and surrounding the slot. An arcuate finger support handle is affixed to the upper end of the front surface of the plate and extends normal to the plate. A picture hanger placement device hook is immovably affixed to the lower end of the plate and also extends normal to the front surface of the plate. The hook has an apex that is adapted to support a wire or other hardware associated with hanging a picture or display.

The picture hanger placement device also includes a flat infinitesimally adjustable slide disposed within the slide track on the rear surface of the plate. A picture hanger placement device position marker is immovably affixed to and extends from the slide in a position opposite the slot so that the picture hanger position marker has a lowermost point of travel that is coincident with the apex of the picture hanger hook.

A linear measurement scale graduated in inches and fractions is disposed along the first edge of the plate, and a metric measurement scale is disposed along the second edge of the plate. Each of the scales has an origin that is aligned with the apex of the picture hanger hook. A generally triangular indicator tab is disposed opposite the picture hanger position marker and adjacent to the front surface of the plate. The indicator tab has a first corner that points toward and indicates the scale on the first edge of the plate, and a second corner that points toward and indicates the scale on the second edge of the plate. A position locking fastener is disposed on the front surface of the plate. The position locking fastener has a connecting portion that extends through the indicator tab and through the slot and engages the slide.

The distance between the apex and picture hanger position marker is adjustable to correspond with the span between the bight of a picture hanger bracket and the fastener passage in the picture hanger bracket so that a user can determine the optimal placement of the picture hanger fastener.

BRIEF DESCRIPTION OF THE DRAWINGS

Similar reference characters denote corresponding features consistently throughout the attached drawings.

BEST MODES FOR CARRYING OUT THE INVENTION

The picture hanger placement device is a thin, flat, elongate plate having a finger or thumb handle or holder at one end and a fixed picture hanger at the opposite end, with a slot extending part of the distance therebetween. At least one linear measurement scale is provided along at least one of the elongate edges of the plate, with there preferably being a fractional inch scale along one edge and a metric scale along the opposite edge. A position marker extends from a slide on the rear side of the plate. A fastener on the front side of the plate extends through the slot in the plate and attaches to the slide on the rear side of the plate. An indicator tab which may be generally triangular is attached to the fastener on the front side of the plate so that the indicator tab moves with the fastener and slide. The corners of the indicator tab indicate a distance measurement on the scale or scales on the lateral edges on the front side of the plate.

In operation, the distance between the nail or fastener passage in a picture hanger bracket and the lowermost point of the bracket hook is measured. The device slide is then adjusted to align the device indicator with this measurement. The picture or article to be hung is then hung from the fixed hanger of the device, and the device (with picture hanging therefrom) is held up to the picture mounting surface and a desired location is identified.

As the device is held precisely in position, the picture is removed from the device, and pressure is applied to the lower portion of the device so that the marking implement on the slide places a mark on the wall. This mark indicates the proper placement of the fastener for the picture hanger bracket. After the fastener is driven through the picture hanger bracket and the picture is hung on the bracket, the picture will be suspended in the desired location identified when the mark was placed on the wall.

Figure 1:
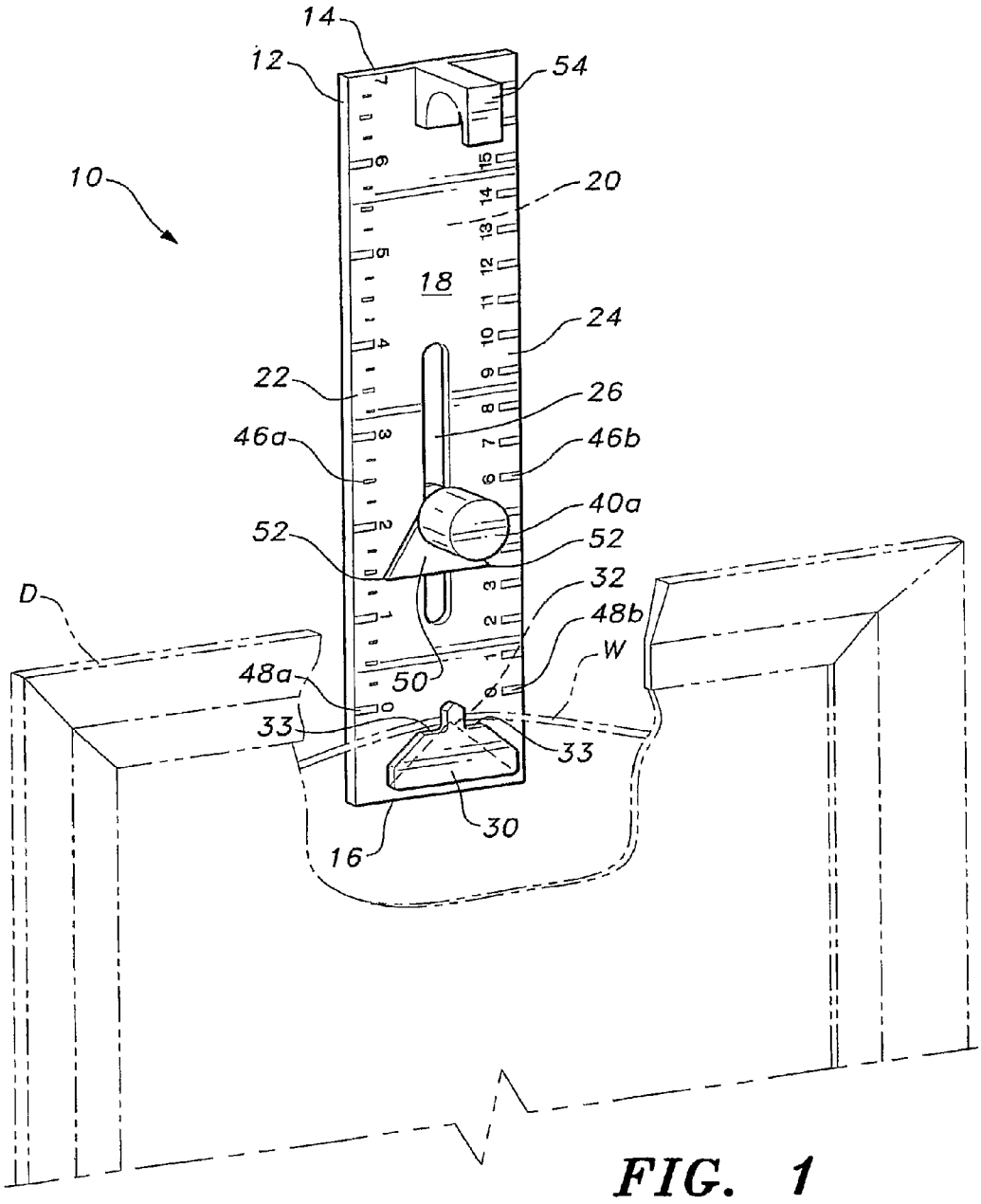
FIG. 1 is an environmental, perspective view of a picture hanger placement device according to the present invention, showing its operation and use.
Figure 2:
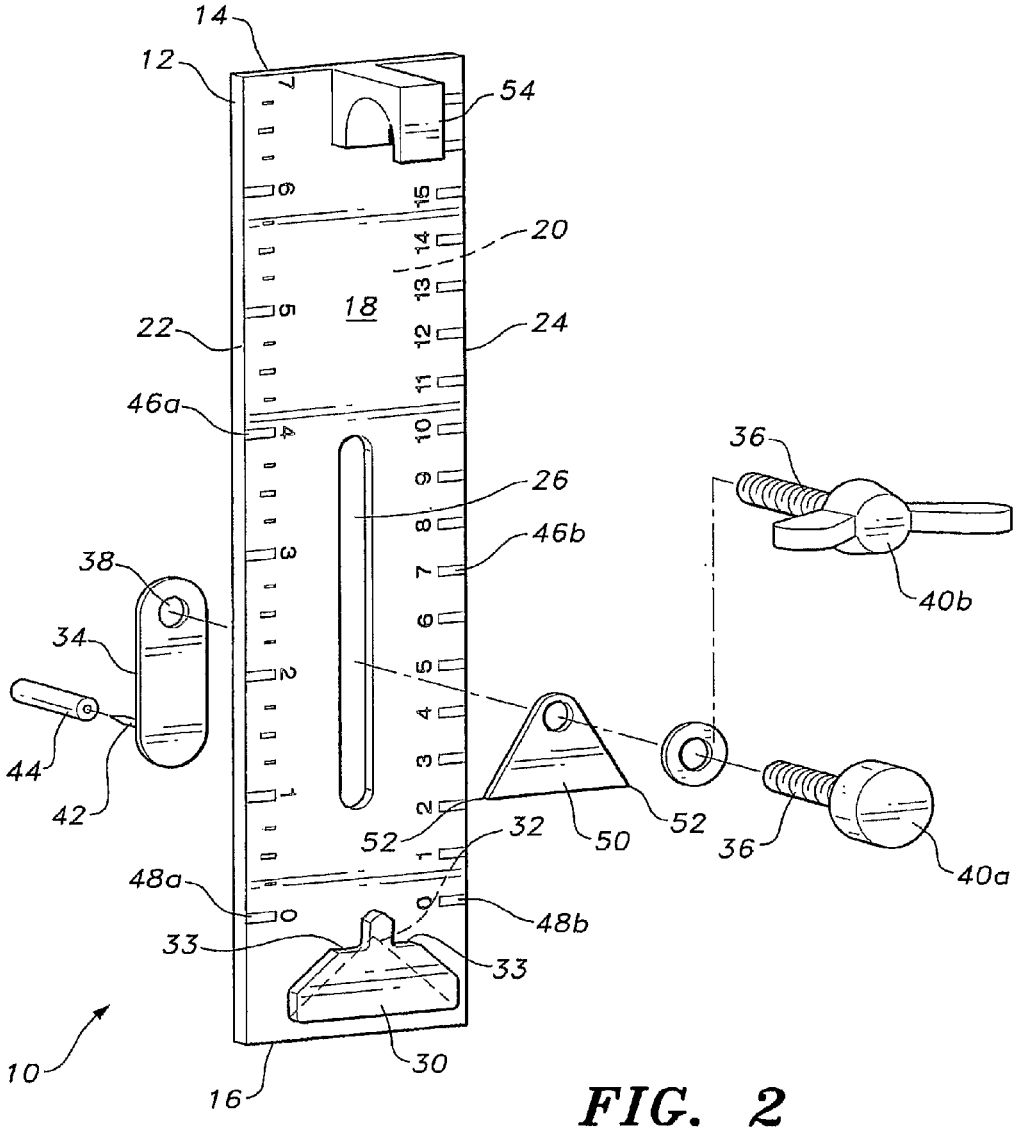
FIG. 2 is an exploded front perspective view of the picture hanger placement device, showing its components and their relationship.
Figure 3:
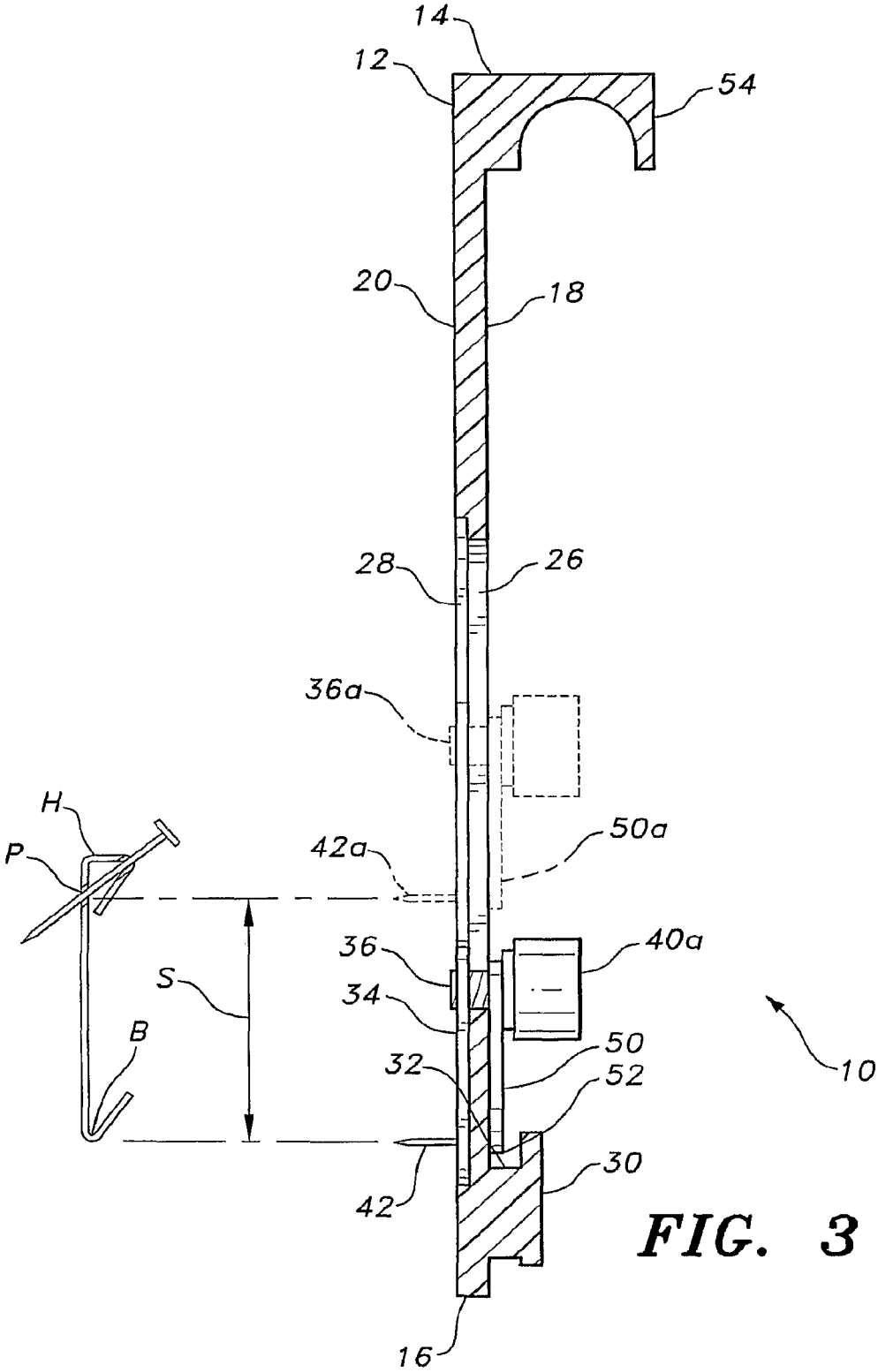
FIG. 3 is a side elevation view in section of the picture hanger placement device, showing further details of its use and operation.

FIG. 1 of the drawings provides an environmental view of the device 10 showing its operation and use, with FIGS. 2 and 3 providing further details of its components and construction. The picture hanger placement device 10 includes a thin, flat, elongate plate 12 to which the various other components attach. The plate 12 includes an upper end 14, an opposite lower end 16, a front surface 18, an opposite rear surface 20, a first edge 22, and an opposite second edge 24. An elongate slot 26 extends completely through the plate 12 between the two opposite ends 14 and 16, with a slide track 28 recessed into the rear surface 20 of the plate 12 and surrounding the slot 26, as shown in FIG. 3.

The plate 12 further includes a picture hanger hook 30 permanently and immovably affixed to, and extending from, the front surface 18 of the plate 12 adjacent the lower end 16 thereof. The hook 30 includes an apex 32 upon which the wire or other hanging hardware associated with the picture or other hanging article is suspended. A notch 33 may be provided in the face of the hook 30 to each side of the apex 32, if desired. This provides for the placement on the hook 30 of certain types of integral hangers found with some types of picture frame and backing assemblies, which otherwise may not fit over the tip of the face of the hook 30.

The rearwardly disposed slide track 28 includes a relatively thin, flat slide 34 disposed for sliding therein, with the outwardly facing surface of the slide 34 being flush with the rear surface 20 of the plate 12. The slide 34 is infinitesimally adjustable within the slide track 28, i.e., there are no fixed adjustment points or stops for the slide 34 other than the two extreme ends of the slide track 28. A slide position locking fastener 36 extends through the slot 26, and threadibly engages a cooperatively threaded passage 38 in the slide 34. The fastener 36 preferably includes some form of gripping device disposed to the front side or surface 18 of the plate 12, e.g., a knob 40*a* or alternatively a winged thumbscrew 40*b* as shown in FIG. 2 of the drawings. The user of the device 10 may thus tighten the gripping device to lock the position of the slide 34 within the slide track 28, or loosen the gripping device to allow the slide 34 to be adjusted within the slide track 28 as desired.

The back of the slide 34, i.e., the outer surface flush with the rear surface 20 of the plate 12, has a picture hanger position marker 42 extending outwardly therefrom, i.e., opposite the slot 26. The marker 42 preferably comprises a small, relatively sharp pin, which may be used to place a small mark in a wall or other picture hanging surface. Alternatively, a marking sleeve 44 may be removably placed over the marker pin 42, as shown in FIG. 2, for use on harder surfaces, e.g. brick, cast concrete or concrete block, etc. The marking sleeve 44 is slipped over the pin 42 and dabbed with a suitable marking agent, e.g., powdered chalk, crayon wax, grease, etc., and used to mark the precise spot on the wall for forming the picture hanger mounting hole.

At least one linear measurement scale is preferably provided along at least one of the lateral edges 22 and/or 24 of the plate 12. Most preferably, a first measurement scale 46*a* is placed along the first edge 22, with a second measurement scale 46*b* placed along the opposite second edge 24. The two scales 46*a* and 46*b* are preferably marked with two different units, e.g., inches and fractions thereof for the first scale 46*a* and metric graduations for the second scale 46*b*. The two scales 46*a* and 46*b* may be swapped to their opposite second and first plate edges 24 and 22 if so desired, and/or other linear marking systems may be used. The measurement scales 46*a*, 46*b* are each provided with an origin point, respectively 48*a*, and 48*b*, aligned or coincident with the apex 32 of the picture hanger hook 30.

The slide 34 includes an indicator tab 50 captured on the slide position locking fastener shank 36, between the fastener grip 40*a* or 40*b* and the front face 18 of the plate 12. In the preferred embodiment, the indicator tag is generally triangular. The indicator tab 50 includes some form of measurement pointer e.g., the two lateral points 52 on the corners of the lower edge of the indicator tab 50, to indicate the position of the tab 50 (and its attached slide 34 and marker pin 42 extending therefrom on the opposite side of the plate 12) relative to either of the two linear measurement scales 46*a* and/or 46*b*. The indicator tab 50 preferably includes some form of conventional alignment means to prevent the tab from rotating relative to the plate 12, e.g. a key or other protrusion extending into the slot 26, etc.

To prepare the device 10 to hang a picture or display D, a user selects a picture hanger bracket H and measures the span S of the picture hanger bracket H. As best shown in FIG. 3, the span S is defined as the distance between the bight B of the picture hanger bracket hook, and the fastener passage P through the hanger bracket back plate. The span S may be measured using either of the scales 46*a* or 46*b* provided along the edges of the plate 12, as best shown in FIGS. 1 and 2.

The fastener knob or grip means 40*a* or 40*b* is then loosened to allow the slide 34 and associated indicator tab 50 to be adjusted. The indicator tab 50 is adjusted so that the lateral pointers 52 point to the measurement corresponding with the span S as defined above. Specifically, the indicator tab 50 is adjusted so that the lateral pointers 52 point to a measurement on the scale(s) 46*a*, 46*b* that corresponds to the span S measurement, where the origin (zero) on the scale(s) 46*a*, 46*b* corresponds with the apex 32 of the hook 30 extending from the plate 12, as well as the bight B of the picture hanger bracket H. Further, the adjusted placement of the position marker 42*a* (shown in FIG. 3) corresponds with the fastener passage P in the picture hanger bracket H. The location of the passage P defines the placement of a fastener (such as a nail) required to hold the picture hanger bracket H in place on a wall.

To position and hang a picture, a user grasps the device 10 by a finger support handle 54 extending from the front surface of the plate 12. As best shown in FIG. 1, the hanger wire W (or other picture hanging hardware) is placed upon apex 32 the hanger hook 30 so that the device 10 supports the display D. When the display D is positioned in the desired location on a wall or support surface, the device 10 is held in place while the display D is removed from the hook 30. Pressure is then applied to the lower end of the plate 12 in the area of the indicator tab 50 and associated lateral pointers 52. This applies pressure to the position marker 42 (or marker sleeve 44, if used) which is directly aligned with the lateral pointers 52, thereby producing a mark on the wall or other support surface that defines the proper location of the picture hanger bracket fastener. The fastener is then driven through the passage P in the picture hanger bracket H and the picture or display D is placed on the bracket.

In conclusion, the picture hanger display device greatly facilitates the precise placement of a picture or other article of display upon a wall or other suitable surface. The display device may be made very economically, with the base plate, slide, indicator, and even the slide fastener being formed of a reasonably durable plastic or perhaps metal if an even more durable device is desired. The device will quickly pay for itself in terms of reduced error and elimination of the need to reposition previously installed picture hangers and the like. Accordingly, the picture hanger display device will prove to be a most valuable accessory for interior decorators and individuals wishing to avoid errors in the hanging of display articles.

It is to be understood that the present invention is not limited to the embodiments described above, but encompasses any and all embodiments within the scope of the following claims.

The invention claimed is:

1. A picture hanger placement device, comprising:

a thin, flat, elongate plate having an upper end, a lower end opposite the upper end, a front surface, a rear surface opposite the front surface, a first edge, a second edge opposite the first edge, an elongate slot disposed between the upper end and lower end and extending completely through the plate, and a recessed slide track defined in the rear surface of the plate and surrounding the slot;

a picture hanger placement device hook immovably affixed to and extending from the front surface of the plate adjacent the lower end thereof, the hook having an apex adapted to support a wire with hanging a picture or display;

a flat infinitesimally adjustable slide disposed within the slide track on the rear surface of the plate;

a picture hanger placement device position marker immovably affixed to and extending from the slide opposite the slot defined in the plate; and a position locking fastener disposed on the front surface of the plate, the position locking fastener having a connecting portion that extends through the slot and engages the slide;

wherein the slide and attached position locking fastener are adjusted so that the picture hanger placement device position marker marks a position on a corresponding support surface that enables a user to precisely position the picture or display on the support surface.

2. The picture hanger placement device according to claim 1, further including at least one linear measurement scale disposed along at least one edge of the plate, the scale having an origin aligned with the apex of the picture hanger placement device hook.

3. The picture hanger placement device according to claim 1, further including:

a linear measurement scale graduated in inches and fractions thereof disposed along the first edge of the plate; and, a metric measurement scale disposed along the second edge of the plate;

each scale having an origin aligned with the apex of the picture hanger placement device hook.

4. The picture hanger placement device according to claim 1, wherein the picture hanger placement device position marker comprises a sharp, rigid, pointed pin having a pliable marker protection and marking sleeve removably disposed thereover.

5. The picture hanger placement device according to claim 1, further including a handle extending from the front surface of the plate, and adjacent the upper end thereof.

6. The picture hanger placement device according to claim 1, further including an indicator tab disposed upon the position locking fastener adjacent the front surface of the plate, the indicator tab having at least one pointer aligned with the picture hanger placement device position marker.

7. The picture hanger placement device according to claim 1, wherein at least the plate is formed of materials selected from the group consisting of plastic and metal.

8. The picture hanger placement device according to claim 1, wherein the distance between the apex of the picture hanger placement device hook and picture hanger placement device position marker, is adjustable to correspond with the span between a bight of a picture hanger bracket and a fastener passage in the picture hanger bracket.

9. The picture hanger placement device according to claim 8, further including:

a linear measurement scale graduated in inches and fractions thereof disposed along the first edge of the plate; and a metric measurement scale disposed along the second edge of the plate;

each scale having an origin aligned with the apex of the picture hanger hook.

10. The picture hanger placement device according to claim 9, further including an indicator tab disposed upon the position locking fastener, the indicator tab having at least one edge aligned with the picture hanger placement device position marker.

11. The picture hanger placement device according to claim 10, wherein the indicator tab is generally triangular with a first corner of the triangle indicating a linear measurement graduated in inches on the first edge of the plate, and a second corner indicating a linear measurement graduated in metric units on the second edge of the plate.

12. The picture hanger placement device according to claim 11, wherein the picture hanger position marker comprises a sharp, rigid, pointed pin having a pliable marker protection and marking sleeve removably disposed thereover.

13. The picture hanger placement device according to claim 12, further including a handle extending from the front surface of the plate, and adjacent the upper end thereof.

14. The picture hanger placement device according to claim 13, wherein the handle is arcuate and extends normal to the front surface.

15. A picture hanger placement device, comprising:

a thin, flat, elongate plate having an upper end, a lower end opposite the upper end, a front surface, a rear surface opposite the front surface, a first edge, a second edge opposite the first edge, and an elongate slot disposed between the upper end and lower end and extending completely through the plate;

an arcuate finger support handle affixed to the upper end of the front surface of the plate and extending normal to the plate;

a picture hanger placement device hook immovably affixed to the lower end of the plate and extending normal to the front surface of the plate, the hook having an apex adapted to support a wire or a hardware associated with hanging a picture or display;

a flat infinitesimally adjustable slide disposed within the slide track on the rear surface of the plate;

a picture hanger placement device position marker immovably affixed to and extending from the slide opposite the slot defined in the plate, the picture hanger placement device position marker having a lowermost point of travel coincident with the apex of the picture hanger placement device hook;

a linear measurement scale graduated in inches and fractions thereof disposed along the first edge of the plate; and a metric measurement scale disposed along the second edge of the plate, each of the scales having an origin aligned with the apex of the picture hanger hook a generally triangular indicator tab opposite the picture hanger position marker and adjacent to the front surface, the indicator tab having a first corner pointing toward and indicating the scale on the first edge of the plate, and a second corner pointing toward and indicating the scale on the second edge of the plate; and a position locking fastener disposed on the front surface of the plate, the position locking fastener having a connecting portion that extends through the indicator tab and the slot and engages the slide;

wherein the distance between the apex of the picture hanger placement device hook and the picture hanger placement device position marker, is adjustable to correspond with the span between a bight of a picture hanger bracket and a fastener passage in the picture hanger bracket so that a user can readily discern the precise placement of the fastener and associated picture hanger bracket for a desired placement of a picture or display.

* * * * *